US005465907A

United States Patent [19]

Hofmann

[11] Patent Number: 5,465,907

[45] Date of Patent: Nov. 14, 1995

[54] FUEL INJECTION NOZZLE FOR INTERNAL COMBUSTION ENGINES

[75] Inventor: Karl Hofmann, Remseck, Germany

[73] Assignee: Robert Bosch GmbH, Stuttgart, Germany

[21] Appl. No.: 176,995

[22] Filed: Jan. 3, 1994

[30] Foreign Application Priority Data

Feb. 10, 1993 [DE] Germany ..... 43 03 813.1

[51] Int. Cl.[6] ..... F02M 61/20

[52] U.S. Cl. ..... 239/533.9; 239/533.3

[58] Field of Search ..... 239/533.2, 533.3, 239/533.9, 533.12

[56] References Cited

U.S. PATENT DOCUMENTS

| | | | |
|---|---|---|---|
| 1,589,245 | 6/1926 | Scott | 239/533.9 |
| 1,879,985 | 9/1932 | Lümmen | 239/533.3 X |
| 3,406,912 | 10/1968 | Claffey | 239/533.3 |
| 3,511,442 | 5/1970 | De Luca et al. | 239/533.3 |
| 4,382,554 | 5/1983 | Hofmann | 239/533.9 |
| 4,801,095 | 1/1989 | Banzhaf et al. | 239/533.3 |
| 4,934,599 | 6/1990 | Hasagawa | 239/533.9 X |
| 5,199,647 | 4/1993 | Yoshizu | 239/533.12 |

FOREIGN PATENT DOCUMENTS

| | | | |
|---|---|---|---|
| 587469 | 11/1932 | Germany | 239/533.3 |
| 2438014 | 3/1975 | Germany | 239/533.3 |
| 2706374 | 8/1978 | Germany | 239/533.9 |
| 3237882 | 4/1984 | Germany | 239/533.12 |
| 918488 | 4/1982 | U.S.S.R. | 239/533.9 |
| 2074234 | 10/1981 | United Kingdom | 239/533.9 |
| 2220984 | 1/1990 | United Kingdom | 239/533.12 |

*Primary Examiner*—Andres Kashnikow
*Assistant Examiner*—Lesley D. Morris
*Attorney, Agent, or Firm*—Edwin E. Greigg; Ronald E. Greigg

[57] ABSTRACT

A fuel injection nozzle for internal combustion engines having a nozzle body with a conical valve seat face and with a valve needle displaceable in the nozzle body, the valve needle having a closing cone cooperating with the seat face in valvelike fashion. To prevent the sealing cone from repeatedly covering the injection ports that begin at the seat face, which can be caused by the natural oscillation of the valve needle during the opening stroke, the valve needle is embodied to have a high natural frequency. To that end, the following segment that adjoins the guide segment guided in the nozzle body and that protrudes freely toward the seat face is embodied as conically tapered toward this seat face. The end segment of the valve needle that carries the closing cone may also be embodied as a thickened head.

4 Claims, 1 Drawing Sheet

FUEL INJECTION NOZZLE FOR INTERNAL COMBUSTION ENGINES

BACKGROUND OF THE INVENTION

The invention relates to a fuel injection nozzle for self-igniting internal combustion engines as defined hereinafter. In seat port nozzles of this kind, as they are called, in which a plurality of injection ports begin at the valve seat in the nozzle body and are distributed over its circumference, the following portion, which adjoins the guide portion of the valve needle and has the closing cone at its tip and freely passes through the blind bore as far as the valve seat face, leaving an annular gap, is cylindrical in shape. At the high injection pressures of 1000 bar and more that are now being sought so as to achieve better fuel preparation, it has been found that the nozzle needle oscillates at its natural frequency during the opening stroke. In the process, its closing cone repeatedly covers some of the openings of the injection ports. The resultant form of atomization deviates from the ideal form, resulting in unfavorable engine performance.

OBJECT AND SUMMARY OF THE INVENTION

In a fuel injection nozzle of the generic type discussed above, this inadequacy is overcome by the provisions recited herein. Tapering its shank gives the valve needle an increased natural frequency that is far above the exciting oscillation range. Advantageous further features of the fuel injection nozzle disclosed are possible with further provisions recited hereinafter.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
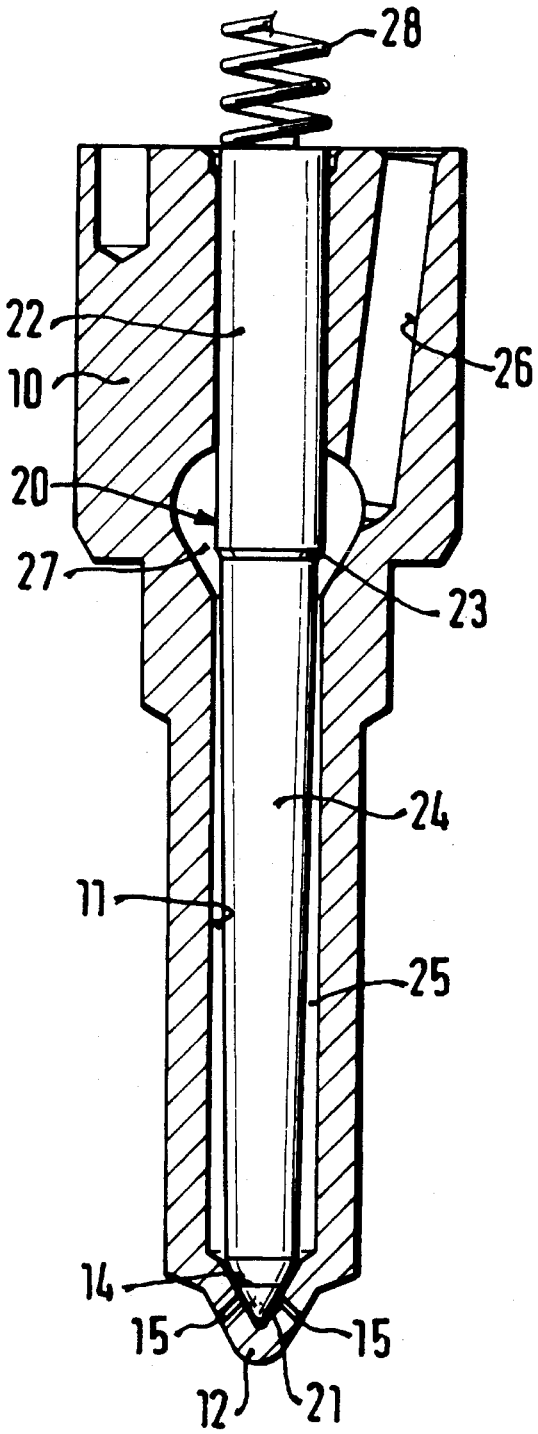
FIGS. 1 and 2 each show the part of a fuel injection nozzle toward the injection, in longitudinal section, on an enlarged scale.

A nozzle body 10, which is secured in a manner known per se to a spring holder, not shown, has a blind bore 11 whose bottom is embodied in a cusp 12, something rounded or cone-like, on the injection end in the form of a conical seat face 14 of a valve. Cooperating with this seat face 14, from which the injection ports 15 that penetrate the cusp 12 begin and discharge into the combustion chamber, is a suitably shaped closing cone 21 on the tip of a valve needle 20.

The valve needle 20, loaded by a closing spring 28, has a guide segment 22, displaceably guided in the inlet region of the nozzle body 10, and a following segment 24 of reduced diameter adjoining the guide segment via a pressure shoulder 23 and having a free end formed as a closing cone 21. The following segment 24 of the nozzle needle 20 has a thickness that is smaller than the width of the surrounding blind bore 11; hence it is surrounded by an annular gap 25 that widens, at the level of the pressure shoulder 23, into a pressure chamber 27 that communicates with a delivery bore 26.

Figure 2:
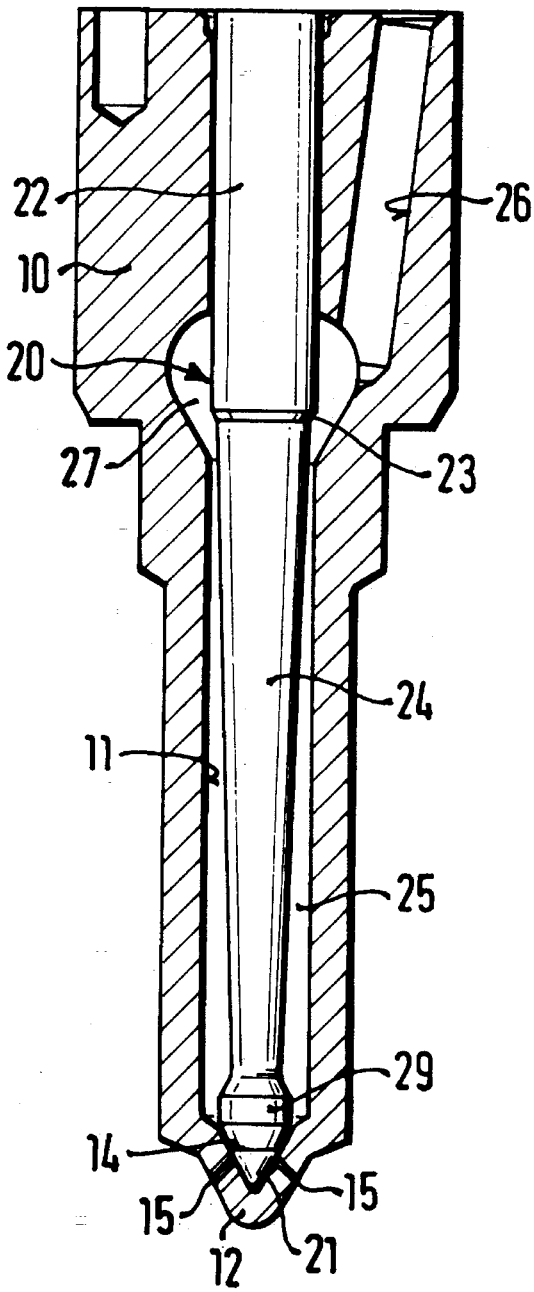

In order to raise the natural frequency of the nozzle needle 20 compared with known nozzle needles, so that in the opening stroke during engine operation the nozzle needle will not be set into oscillation, which would cause its free closing cone 21 to repeatedly cover some of the injection ports 15, the following segment 24 of the nozzle needle 20 is conically embodied; it tapers toward the closing cone 21. In the exemplary embodiment of FIG. 1, the following segment 24 is embodied as a truncated cone with an angle of inclination in the range of from 0.5° to 1.5°, and preferably 0.9°. In the exemplary embodiment of FIG. 2, the following conical segment 24 has a larger angle of inclination having a range to 5°, preferably 3° and in return the portion carrying the closing cone 21 is embodied as a thickened head 29, so that the closing cone 21 completely covers the seat face 14. The head 29 also creates streamlined inlet conditions in the valve region and good damping.

It should also be noted that as an alternative to the exemplary embodiments described, the following segment may also adjoin the guide segment of the valve needle without a pressure shoulder, if the width of the blind bore and the pressure chamber allow it. The injection ports beginning at the seat face 14 of the valve body 10 are distributed over the circumference thereof. Their diameter, number and inclination are adapted to the combustion chamber of the engine.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for self-igniting internal combustion engines, comprising a nozzle body having a blind bore, a conical valve seat face in a bottom end portion of said blind bore, injection ports which begin in said conical valve seat face are formed in said bottom end portion of said blind bore, a valve needle loaded by a closing force, the valve needle being displaceably guided by a guide segment (22) in an inlet region of the nozzle body, said valve needle includes a closing cone on a free end of a following segment (24) of reduced diameter of said valve needle that adjoins the guide segment (22) and the closing cone, the following segment (24) tapers conically toward the closing cone (21) and the closing cone cooperates with the conical valve seat face in the bottom end portion of said blind bore to close and open said injection ports that begin in said conical valve seat face.

2. A fuel injection nozzle as defined by claim 1, in which an angle of inclination of the following segment (24) is in a range of from 0.5° to 5°.

3. A fuel injection nozzle as defined by claim 1, in which the free end segment of the following segment (24) carrying the closing cone (21) is thickened in the manner of a head (29).

4. A fuel injection nozzle as defined by claim 2, in which the free end segment of the following segment (24) carrying the closing cone (21) is thickened in the manner of a head (29).

* * * * *